US005651543A

United States Patent [19]

Kayser et al.

[11] Patent Number: 5,651,543

[45] Date of Patent: Jul. 29, 1997

[54] ENVELOPE OFFSET APPARATUS

[75] Inventors: David E. Kayser, Middlebury; Joseph H. Marzullo, Brookfield, both of Conn.

[73] Assignee: Pitney Bowes Inc., Stamford, Conn.

[21] Appl. No.: 510,351

[22] Filed: Aug. 2, 1995

[51] Int. Cl.[6] ..... B65H 29/44

[52] U.S. Cl. ..... 271/181; 271/220; 271/2; 414/791.2

[58] Field of Search ..... 271/181, 180, 271/177, 220, 2; 414/791.2, 798.7; 209/584, 900

[56] References Cited

U.S. PATENT DOCUMENTS

| | | | |
|---|---|---|---|
| 3,458,383 | 7/1969 | Kirk et al. | 156/566 |
| 3,667,623 | 6/1972 | Frazier et al. | 271/181 X |
| 3,716,227 | 2/1973 | Botteher | 271/180 |
| 4,314,644 | 2/1982 | Stocker | 209/569 |
| 4,718,657 | 1/1988 | Otter | 271/184 |
| 5,104,681 | 4/1992 | Sansone | 427/8 |
| 5,288,066 | 2/1994 | Hain | 271/181 |
| 5,551,834 | 9/1996 | Thompson et al. | 271/180 X |

FOREIGN PATENT DOCUMENTS

| | | | |
|---|---|---|---|
| 0653367 | 11/1909 | European Pat. Off. | 95/20 |
| 580336 | 7/1933 | Germany | 271/180 |

*Primary Examiner*—David H. Bollinger
*Attorney, Agent, or Firm*—Ronald Reichman; Melvin J. Scolnick; Brigitte L. Jeffery

[57] ABSTRACT

In a stacker apparatus for stacking mail pieces, an offset apparatus is included to cause lateral registration of a vertically oriented mail piece to a preselected side registration wall. The offset apparatus is comprised of a generally conical elastomer roller which is fastened to the shaft of a drive motor. The roller engages the bottom edge of a mail piece in order to urge the mail piece towards a preselected side registration wall.

6 Claims, 5 Drawing Sheets

ENVELOPE OFFSET APPARATUS

This invention relates to an envelope offset apparatus designed for use in connection with an envelope stacker such as one of the general type shown in the co-pending application of Joseph H. Marzullo and David Kayser, Ser. No. 08/510,209, filed Aug. 2, 1995.

BACKGROUND OF THE INVENTION

In accordance with USPS practice, reductions are granted in postage charges for batches of mail when more than a specific number of mail pieces are directed to a particular three or five digit zip code. As shown in U.S. Pat. No. 5,104,681 for a Method and Apparatus for Marking Letter Mail, issued Apr. 14, 1992 to Ronald P. Sansone and assigned to the assignee of the present invention, it is known in the art to print marks on the edge of certain pieces of mail that indicate a zip code break, i.e., the location in a serially processed group of mail pieces at which the zip code changes. However, the addition of indicating marks detract from the appearance of the mailpiece. It is accordingly an object of the invention to provide indicating means to the operator collecting mail pieces from a stacker to indicate separate groups of mail pieces including, but not limited to, those mail pieces which are sealed or unsealed, different mailing jobs, or changes in the zip code.

SUMMARY OF THE INVENTION

The above object is achieved and the disadvantages of the prior art are overcome by means of the subject invention which comprises an apparatus for offsetting a vertically oriented mail piece. In a preferred embodiment of the invention, the apparatus comprises a horizontal deck having an aperture. The apparatus further has a first lateral abutment means fixably mounted to the deck and extending substantially vertically therefrom. A second lateral abutment means is transversely spaced apart from the first abutment means. Further, the second abutment means is fixably mounted to the deck and extends substantially vertically therefrom. Offsetting means are disposed between the first abutment means and the second abutment means. The offsetting means extend through the aperture so as to engage a bottom edge of the mail piece. Drive means are rotatively connected to the offsetting means for rotating the offsetting means in a predetermined direction whereby on rotating in a direction toward the first lateral abutment means, a first side edge of the mail piece laterally registers against the first abutment means, and, whereby on rotating in a direction toward the second lateral abutment means, a second side edge of the mail piece laterally registers against the second abutment means.

BRIEF DESCRIPTION OF THE DRAWINGS

These and other objects and advantages of the present invention will become apparent from the following description of the accompanying drawings. It is to be understood that the drawings are to be used for the purpose of illustration only, and not as a definition of the invention.

In the drawings.

DESCRIPTION OF THE PREFERRED EMBODIMENT

Figure 1:
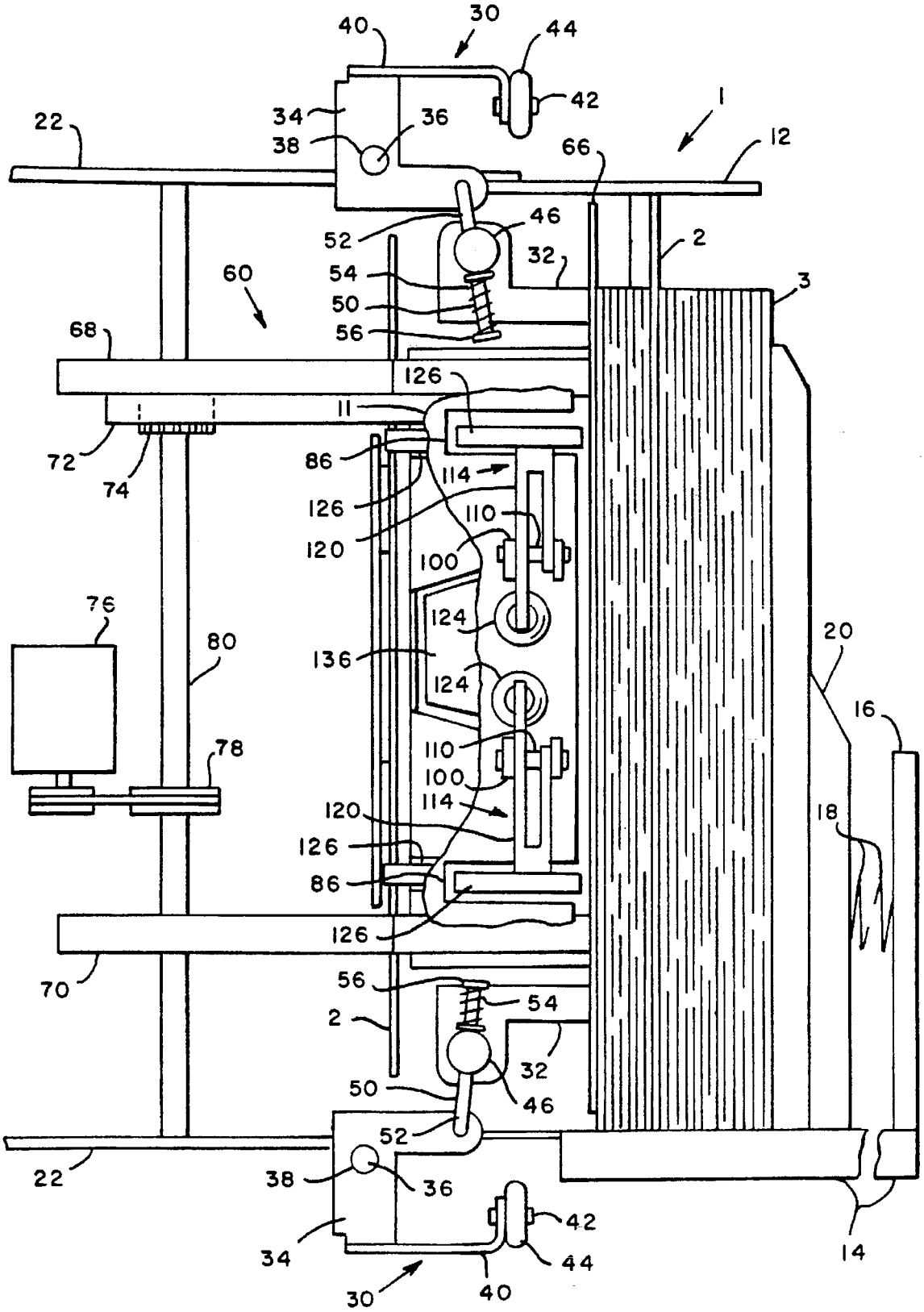
FIG. 1 represents a fragmented, top view of the envelope offset apparatus.

FIG. 1 illustrates a preferred embodiment showing a top perspective view of an envelope offset apparatus 1 having a lower deck 10 which has fixably mounted thereto, in vertical alignment, transversely spaced apart side walls 12 and 14. The side walls serve principally as a lateral registration abutment for each envelope 2 in the envelope stack 3. Lower deck 10 has a guiding edge 15 for guiding an envelope 2 into the stacker 1. The lower deck 10 is fixably attached to a rear wall 16. A spring 18, having one end fixedly attached to the rear wall 16, and the other end thereof fixedly attached to a plate 20, supplies a biasing force which causes the plate 20 to remain in contact with a forwardmost envelope in the envelope stack 3. The plate 20 serves principally as a longitudinal registration abutment for the envelope stack 3 and secondarily as an obstructing mechanism which halts the forward movement of the envelope stack 3.

Still referring to FIG. 1, pivotally mounted to a frame 22 of the envelope stacker 1 is a normal force roller assembly 30 which comprises a plate 32 and a bracket 34 having a pivot pin 36 and an aperture 38. The bracket 34 further has an arm 40 with a shaft 42 extending therefrom. An idler roller 44 is mounted to shaft 42.

A hub 46 rotatably mounted to plate 32 has a slot 48 through which extends a generally L-shaped pin 50. A first end portion 52 of the L-shaped pin 50 engages aperture 38 of bracket 34. A spring 54 is coiled around the L-shaped pin 50 between a second end portion 56 of the pin 50 and the hub 46.

Figure 2:
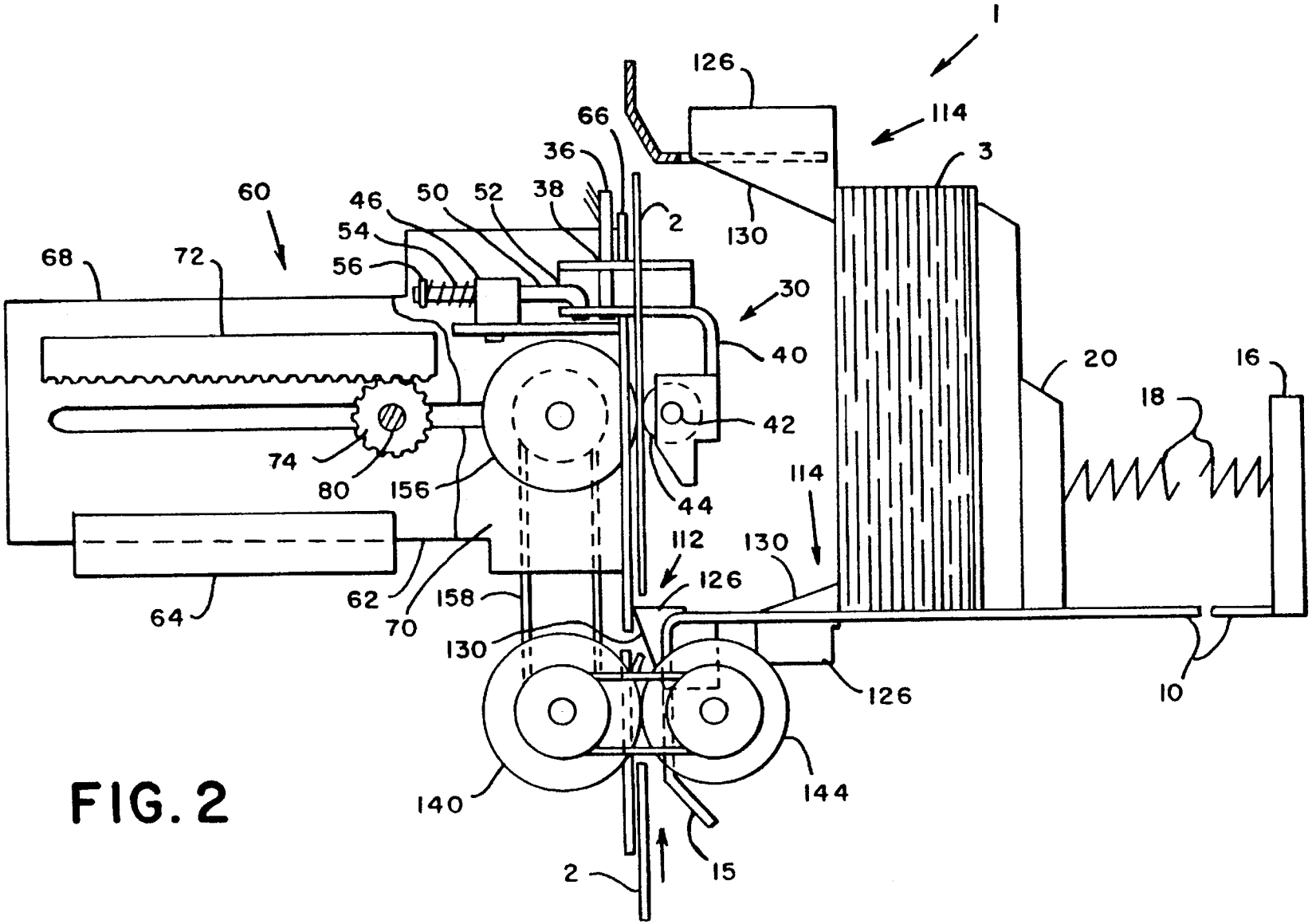
FIG. 2 represents a fragmented, side view of the FIG. 1 apparatus.

Referring now to FIGS. 1 and 2 concurrently, a vertically aligned pusher 60 is fixably attached to plate 32. Pusher 60 is comprised of a base 62 supported by guides 64, a forward wall 66, and side walls 68 and 70 in transversely spaced apart parallel alignment. Side wall 68 has mounted thereon a rack gear 72. Pinion gear 74 is operatively connected to the rack gear 72. A motor 76 is in drive communication with idler gear 78 which shares a common shaft 80 with pinion gear 74 whereby rotation of the motor 76 thereby rotates the pinion gear 74.

Figure 3:
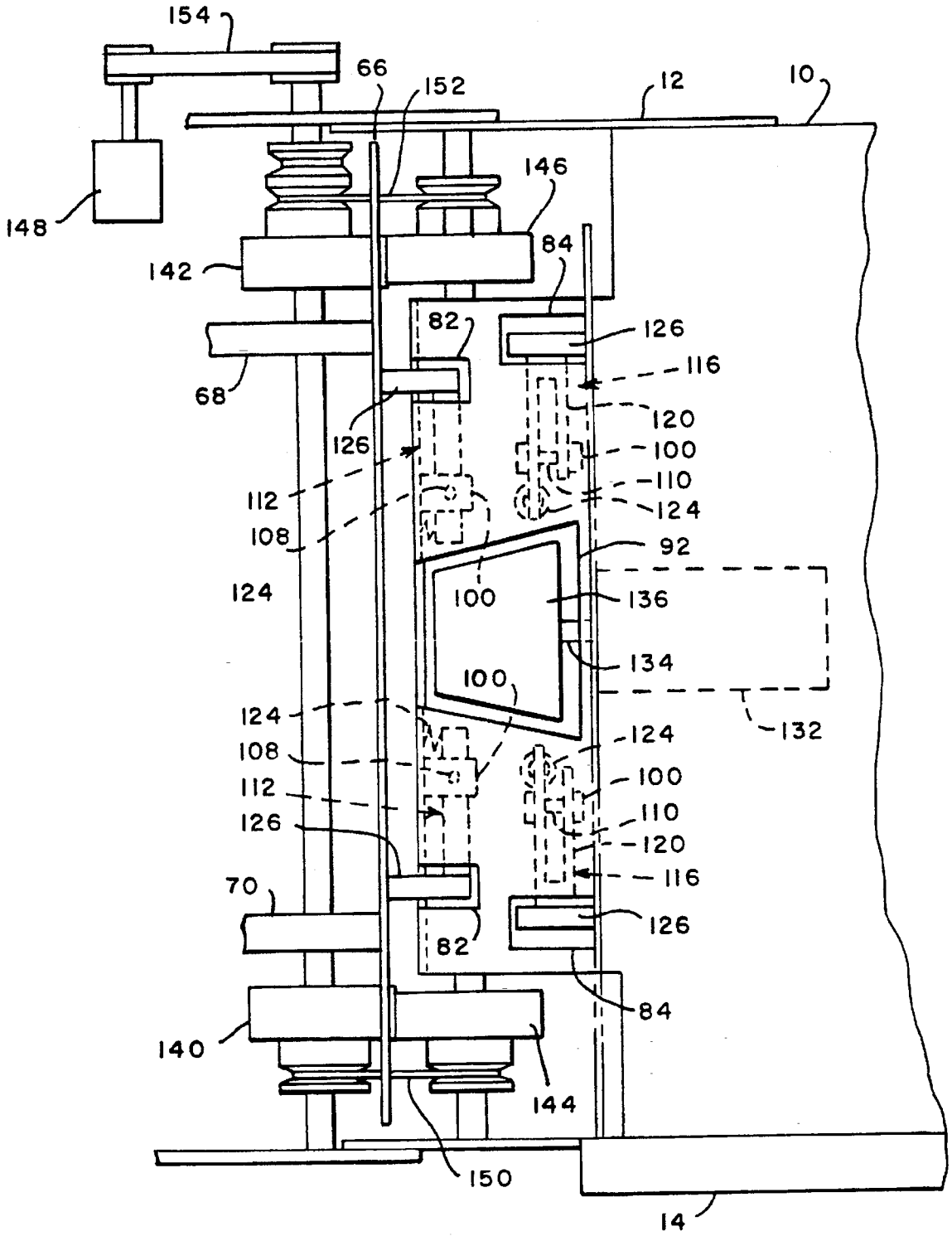
FIG. 3 represents a fragmented, cross-sectional top view of the apparatus.

Referring to FIGS. 1 and 3, the lower deck t0 and an upper deck 11 contain a plurality of slots 82, 84, 86, and 92. Fixably mounted to the underside of the lower deck 10 and upper deck 11 are a plurality of substantially U-shaped mounting blocks 100. Each mounting block 100 has a plurality of apertures 108 for receiving a pivot pin 110. Input gates 112 are connected to blocks 100 mounted to the underside of the lower deck 10. Output gates 114, 116 are connected to blocks 100 mounted to the underside of upper deck 11 and lower deck 10 respectively. The gates 112, 114, and 116 include a yoke-shaped end portion 120 pivotally connected to the mounting block 100 by means of pin 110 such that the end portion 120 is oriented parallel to the decks 10, 11. In order to retain the gates 112, 114, and 116 in a home position, a spring 124 is secured to the deck 10 or 11. The spring 124 has a free end which engages the end portion 120 of gates 112, 114, and 116 thereby biasing the gates 112, 114, and 116 toward the home position.

Referring to FIGS. 2 and 3, each gate 112, 114, and 116 further has a front portion 126 having an angled surface 130. The front portion 126 of each gate 112, 114, and 116 extends generally perpendicular to the end portion 120 so that in the home position, the angled surface 130 extends through the slots 82, 84, 86 in the deck 10, 11.

Still referring to FIG. 3, mounted to the underside of the lower deck 10 is a motor 132 having a shaft 134. A generally conical shaped elastomer roller 136 is mounted onto the shaft 134 of the motor 132. The roller 136 extends above the lower deck 10 through slot 92 in deck 10. Roller 136 will rotate in a clockwise or counterclockwise direction depending upon the direction of rotation of motor shaft 134.

Referring now to FIGS. 2 and 3 concurrently, driving means for driving an envelope 2 into the envelope stacker 1 comprises feed rollers 140, 142, 144, 146 rotated by a motor 148 coupled thereto by suitable means such as a pulley drive 150, 152, or 154 entrained about rollers 140, 142, 144, 146. Roller 156 is in drive communication with roller 140 by means of pulley 158.

PRACTICAL OPERATION

In the operation of our envelope stack offset apparatus 1, it is desirable to provide indicating means to the operator collecting the envelopes from the stacker to indicate separate groups of envelopes including, but not limited to, those envelopes which are sealed or unsealed, different mailing jobs, or changes in the zip code.

Turning now to FIG. 1, the operation of a specific embodiment of the present invention is illustrated. In the home position depicted in FIG. 1, the pinion gear 74 is in rearmost engagement with the rack gear 72 Accordingly, the pusher 60 is at a forwardmost position so that the forward wall 66 maintains contact with the last fed envelope of the stack of envelopes 3. In the forwardmost position, the pusher 60 applies pressure to the last fed envelope to further assist adhesion of the envelope flap to the envelope body if the envelope was moistened before entering the stacker 1. In home position, the idler roller 44 remains disengaged from feed roller 156.

When the stacker 1 receives a signal that an envelope is being transported to the stacker 1, the motor 76 begins to rotate thereby moving the pinion gear 74 forward within rack 72. This results in the pusher 60 traveling in a rearward direction thereby causing the L-shaped pin 50 engaged with bracket 34 to pivot the idler roller 44 into contact with feed roller 156. The output gates 114 in conjunction with the spring biased plate 20 hold the stack of envelopes 2 in an upright, vertical position to prevent the envelopes from falling back and into the path of an incoming envelope in the absence of pusher 60 (see FIG. 2).

Figure 4:
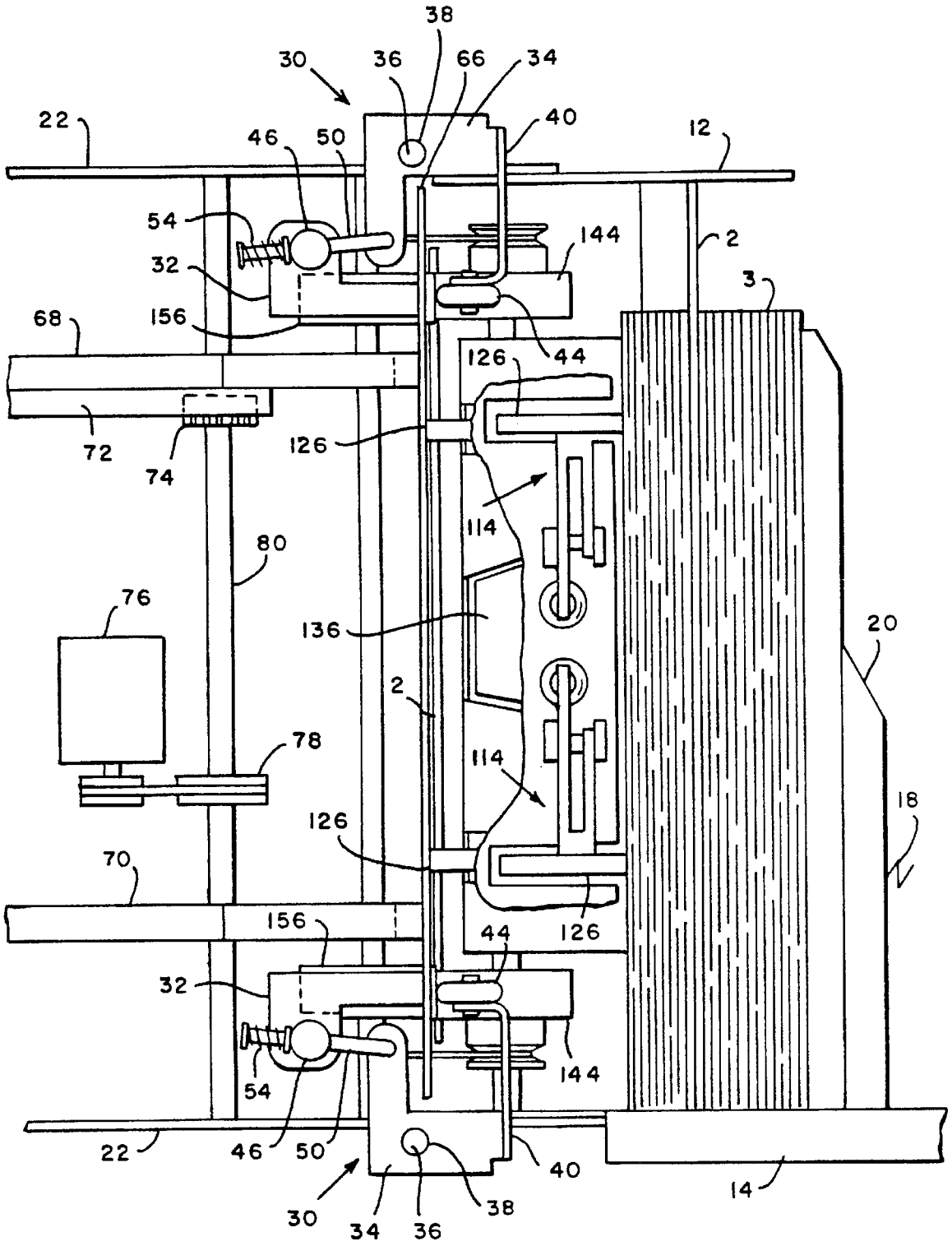
FIG. 4 represents a fragmented, top view of the apparatus receiving a mail piece.

Referring to FIGS. 2 and 4, upon receiving an appropriate signal, the driving means drive an incoming envelope 2 into the stacker 1. A vertically fed envelope 2 is guided between the nip of rollers 140 and 144 by the guiding edge 15 of the lower deck 10. The envelope 2 is transported vertically thereby engaging the angled surface 130 of the input gates 112. The driving force of the envelope 2 against the input gates 112 will cause the gates 112 to pivot in a direction perpendicular to the vertical path of travel of the envelope 2 thereby permitting the envelope 2 to engage the nip formed by feed roller 156 and idler roller 44. After the bottom edge of the envelope 2 clears the input gates 112, the spring biased gates 112 will return to the home position and the driving means will cease driving the envelope 2.

Figure 5:
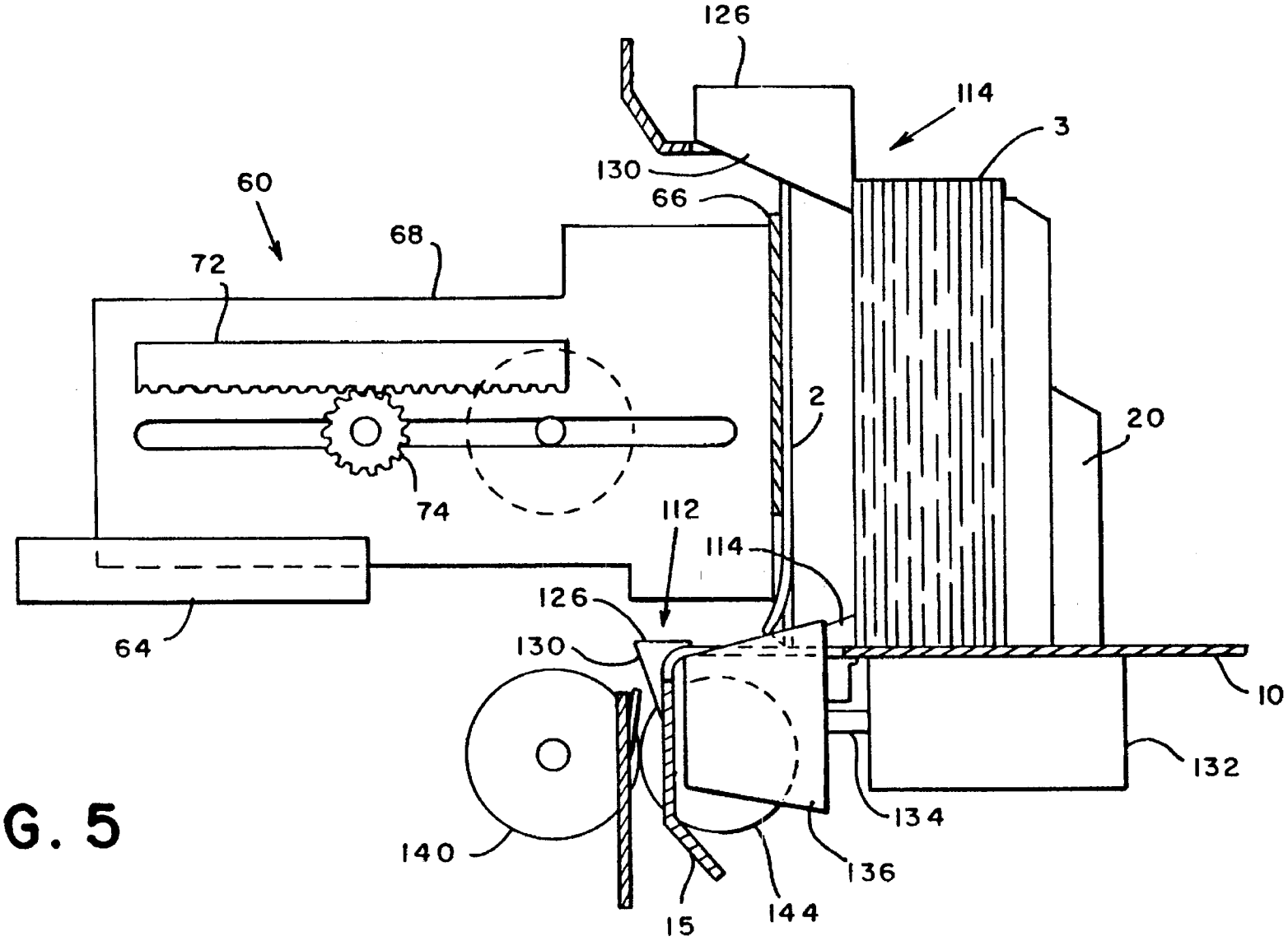
FIG. 5 represents a side view of the apparatus receiving a mail piece.

Referring to FIG. 5, the pinion gear 74 will rotate so as to move the pusher 60 forward thereby causing the L-shaped pin 50 engaged with bracket 34 to pivot the idler roller 44 out of contact with feed roller 156. Pivoting the idler roller 44 will cause the envelope 2 to drop vertically onto the top of the input gates 112. The motor 76 will momentarily discontinue forward motion of the pinion gear 74 as the envelope 2 settles on the input gates 112.

Still referring to FIG. 5, after pausing for a predetermined time, the motor 76 will resume driving the pinion gear 74 so that the pusher 60 moves forward, displacing the vertically oriented envelope 2 in a substantially horizontal direction. As the pusher 60 moves forward, the forward wall 66 drives the envelope 2 into contact with the surface of the elastomer roller 136. The forward motion of the pusher 60 causes the envelope 2 to bend thereby providing additional normal force for driving the envelope 2 forward, across the elastomer roller 136. As the envelope 2 is driven forward, the roller 136 begins to rotate in a predetermined direction. The rotation of the elastomer roller 136 in a predetermined direction will drive the envelope 2 laterally against a side registration edge 12 or 14 to either offset the envelope 2 or register and align the envelope 2 with a common group of envelopes. The pusher 60 continues to drive the envelope 2 forward and into contact with the angled surface 130 of the output gates 114. As the pusher 60 moves forward, the top edge and bottom edge of the envelope 2 causes the output gates 114 to rotate in a direction perpendicular to the horizontal path of travel of the envelope 2.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. An apparatus for offsetting a vertically oriented mail piece, comprising:

a horizontal deck having an aperture;

a first lateral abutment means fixably mounted to the deck and extending substantially vertically therefrom said first lateral abutment acts as a lateral registration for orienting the mail piece;

a second lateral abutment means transversely spaced apart from the first abutment means, the second abutment means being fixably mounted to the deck and extending substantially vertically therefrom said second lateral abutment acts as a lateral registration for orienting the mail piece;

offsetting means disposed between the first abutment means and the second abutment means, the offsetting means extend through the aperture so as to engage a bottom edge of the mail piece in order to urge the mail piece towards said first or second lateral abutment means; and drive means rotatively connected to the offsetting means for rotating the offsetting means in predetermined directions whereby on rotating in a direction toward the first lateral abutment means, a first side edge of the mail piece laterally registers against the first abutment means, and, whereby on rotating in a direction toward the second lateral abutment means, a second side edge of the mail piece laterally registers against the second abutment means.

2. The apparatus according to claim 1 wherein the offsetting means comprises a generally conical shaped roller.

3. The apparatus according to claim 2 further comprising pushing means positioned downstream of the offsetting means for engaging a rear portion of the mail piece and urging the mail piece toward the offsetting means in a direction perpendicular to the rotation direction of the offsetting means.

4. The apparatus of claim 3 wherein the pushing means urges the mail piece toward the offsetting means so that the bottom edge of the mail piece engages the offsetting means.

5. The apparatus of claim 1 further comprising receiving means coupled to said drive means for receiving and transporting the vertically oriented mail piece.

6. The apparatus of claim 5 wherein a horizontal deck of said receiving means includes a guiding edge for guiding the mail into engagement with the receiving means.

* * * * *